United States Patent [19]

Cloostermans-Huwaert

[11] Patent Number: 4,549,420

[45] Date of Patent: Oct. 29, 1985

[54] METHOD FOR MANUFACTURING WIRE

[75] Inventor: Leon R. L. G. Cloostermans-Huwaert, Maarkedal, Belgium

[73] Assignee: Lamitref Aluminium, Hemiksem, Belgium

[21] Appl. No.: 509,019

[22] Filed: Jun. 29, 1983

[30] Foreign Application Priority Data

Jul. 5, 1982 [LU] Luxembourg ..... 84257

[51] Int. Cl.[4] ..... B21B 15/00; B21B 45/02; B21C 1/04; B21C 9/00

[52] U.S. Cl. ..... 72/41; 72/206; 72/278

[58] Field of Search ..... 72/39, 41, 42, 43, 206, 72/274, 278, 279, 280, 282, 283, 284, 286

[56] References Cited

U.S. PATENT DOCUMENTS

| | | | |
|---|---|---|---|
| 3,143,786 | 8/1964 | Jones et al. | 72/206 |
| 3,417,589 | 12/1968 | Bobrowsky | 72/60 |
| 3,590,622 | 7/1971 | Elge et al. | 72/283 X |
| 3,605,466 | 9/1971 | Kilcoin | 72/43 |
| 3,677,056 | 7/1972 | Properzi | 72/227 |
| 3,686,908 | 8/1972 | Krafft | 72/43 |
| 3,806,366 | 4/1974 | Cofer et al. | 72/39 |
| 4,080,818 | 3/1978 | Grè | 72/41 |
| 4,202,193 | 5/1980 | Wilson | 72/42 |
| 4,469,534 | 9/1984 | Hesterlee | 72/286 X |

FOREIGN PATENT DOCUMENTS

| | | | |
|---|---|---|---|
| 0011612 | 5/1980 | European Pat. Off. . | |
| 0053636 | 6/1982 | European Pat. Off. . | |
| 966562 | 8/1957 | Fed. Rep. of Germany | 72/278 |
| 2362051 | 6/1975 | Fed. Rep. of Germany . | |
| 528642 | 11/1921 | France . | |
| 1021669 | 2/1953 | France | 72/206 |
| 2066010 | 8/1971 | France . | |
| 2421009 | 10/1979 | France . | |
| 374934 | 6/1932 | United Kingdom | 72/206 |

OTHER PUBLICATIONS

H. Brauer et al, "Developments—Rolling Mill Blocks in Modern Kocks Mills", Iron and Steel Engineer, vol. 55, No. 1 (1/1978), pp. 55–67.

*Primary Examiner*—E. Michael Combs

*Attorney, Agent, or Firm*—Stevens, Davis, Miller & Mosher

[57] ABSTRACT

The wire-cross-section is first reduced down to an intermediate cross-section by subjecting the wire to a cold-rolling in a rolling-section with a plurality of stands which is part of a manufacturing unit. The cross-section is continuously further reduced down to the required cross-section in a wire-drawing section forming also part of the manufacturing unit. The first step in the reducing in the wire-drawing section is performed in a roller die, the other steps being performed in normal dies. The lubricating oil circuit for the roller die is completely isolated from the lubricating oil circuit for the other dies. After wire-drawing the wire is coiled on a coiling-machine.

1 Claim, 4 Drawing Figures

METHOD FOR MANUFACTURING WIRE

BACKGROUND

This invention relates to a method for manufacturing a small-cross-section wire from a wire having a larger cross-section, in which the wire cross-section is reduced by cold-rolling in a plurality of steps.

In such a known method, the cross-section reducing is obtained exclusively by rolling.

This method has some advantages relative to another known method for reducing a wire cross-section, in which the cross-section reducing is obtained exclusively by wire-drawing in a plurality of steps.

In the first place, feeding a new wire to a rolling unit is very simple. It is only necessary to feed the wire to the first stand and it will then be fed automatically to the following stands. The starting of the unit may thus occur rapidly.

The feeding or the feeding anew of a wire to a wire-drawing unit on the other hand is more intricate. The wire-drawing unit with a plurality of steps has to comprise a relatively high number of dies and as feeding the wire to be drawn to the dies requires a lot of time, there results therefrom a substantial time loss whenever a new wire to be drawn has to be fed to the wire-drawing unit or should the wire break. This is particularly true with wires from aluminum alloy having a relatively large diameter, said wires being rather rigid.

In the second place, the danger of a wire breaking during rolling is much less acute than during wire-drawing.

With wire-drawing, the danger of the wire breaking is quite high, mostly as the number of succeeding reducings is rather high and the total reducing rate is rather substantial. The wire may easily be overstressed, particularly when such wire is made from aluminum alloy.

Indeed, during the reducing by a wire-drawing step, too-strong axial tensile stresses may be generated in the wire, and structural damages may occur in said wire. Now it is impossible to avoid generating axial tensile stresses in the wire, due to the friction, the die angle, and the wire return stress. Such axial stresses generate hollows in the location of small faults in the wire material. Such hollows increase during the succeeding steps and may reach such a size that the actual wire cross-section be severely reduced. The wire may then be more easily overloaded and break in such locations.

Moreover the surface area of the wire is subjected to sliding stresses, which may cause damages to the surface, mostly in combination with faults in the material and/or the friction and/or an out of center position of the wire inside the die.

Rolling causes much less sliding stresses on the wire surface, and the danger of damaging the wire surface is much less severe than during wire-drawing.

In the third place, rolling generates an increase in the temperature which is much less substantial than with wire-drawing.

The energy used for wire-drawing splits-up in 45% homogeneous distortion energy, 10% extreme distortion energy, and 45% friction energy. The homogeneous distortion energy is converted for 90% into heat and the friction energy is completely converted into heat. There results therefrom that each wire-drawing step causes an increase in the wire temperature. As the wire cooling between the various steps is limited, the wire temperature increases from one step to the following step, such increase being all the greater as the wire speed is high. This is particularly true when use is made of a sliding wire-drawing unit. Too-high a heating will cause a break in the lubricant layer surrounding the wire, which might generate surface faults.

With rolling on the other hand, the friction energy is much less substantial; generally no more than 15% of the distortion energy. Consequently, the heating during each rolling step is much lower. Moreover, the generated heat may easily be dissipated in the rolls, in such a way that the cooling action is stronger. There results therefrom that there is substantially no heat accumulating in the wire during the various rolling steps.

As the technical features of the resulting wire, such as the breaking stress, the elongation and the resistivity, are dependent on the wire temperature, the accumulating heating during wire-drawing does limit the wire speed for a particular wire-drawing unit and for particular technical features of the wire.

The technical features of the wire are indeed dependent on the cellular structure which is developed during the treatment. The finer such structure is and the higher will be the breaking stress and the resistivity while the elongation is reduced. A higher temperature causes recovery of the cellular structure. By cooling between two dies, such recovery is controlled.

The lack of such accumulating heating during rolling has the advantage that the technical features of the wire are not dependent on the wire speed and that higher wire speeds may be used.

Such independence of the technical features from the speed is however at the same time a drawback, as it is impossible during rolling to control or change the technical features for a given cross-section reducing by acting on the wire speed.

Besides the above, rolling has further drawbacks relative to wire-drawing.

Indeed, the surface of the wire resulting from rolling is substantially lower in quality than the surface of a wire obtained by wire-drawing.

Moreover, it is not possible to obtain with rolling as accurate a size and a shape of the final wire cross-section than with wire-drawing.

Replacing the rolls from the rolling stands is very time-consuming.

The invention has for object to obviate the above drawbacks and to provide a method for manufacturing wire which allows to obtain wire of good quality and with the required technical features, with an increased throughput relative to the known methods.

THE INVENTION

For this purpose, the wire cross-section is first reduced down to an intermediate cross-section by subjecting the wire to cold-rolling in a multi-stand rolling section which is part of a manufacturing unit which also comprises a multi-step wire-drawing section, and the cross-section reducing is then continuously pursued by drawing in the wire-drawing section of the manufacturing unit, down to the required cross-section.

The combination of cold-rolling and wire-drawing does not only allow to obtain the advantges of both methods without the drawbacks thereof, but it does also allow to increase the production rate of wire having the required technical features.

In a particular embodiment of the invention, the wire is subjected to cold-rolling in a rolling section with a plurality of stands having a fixed cross-section reducing.

In an advantageous embodiment of the invention the cross-section is reduced by wire-drawing in a wire-drawing section with constant elongation at each step.

In a preferred embodiment, the wire is wound after drawing by means of a coiling machine.

In a particularly efficient embodiment of the invention, use is made for the wire, of an aluminum alloy wire.

Use is preferably made of a wire from an aluminum alloy which comprises magnesium and silicon.

The invention further pertains to the wire obtained with the above-defined method, as well as to a manufacturing unit which is obviously intended for the working of said method. Such an unit is characterized in that it comprises a cold-rolling section and a wire-drawing section.

Other features and advantages of the invention will stand out from the description of a method for manufacturing wire, of a wire thus obtained and of a manufacturing unit used for the working of said method, according to the invention; this description is only given hereinafter by way of non limitative example and with reference to the accompanying drawings.

DRAWINGS

DETAILED DESCRIPTION OF THE PREFERRED EMBODIMENT

A wire 1 from aluminum or aluminum alloy, which is manufactured in a known way in a hot rolling mill, is continuously elongated down to a required diameter in two main steps in one and the same manufacturing unit.

Figure 1:
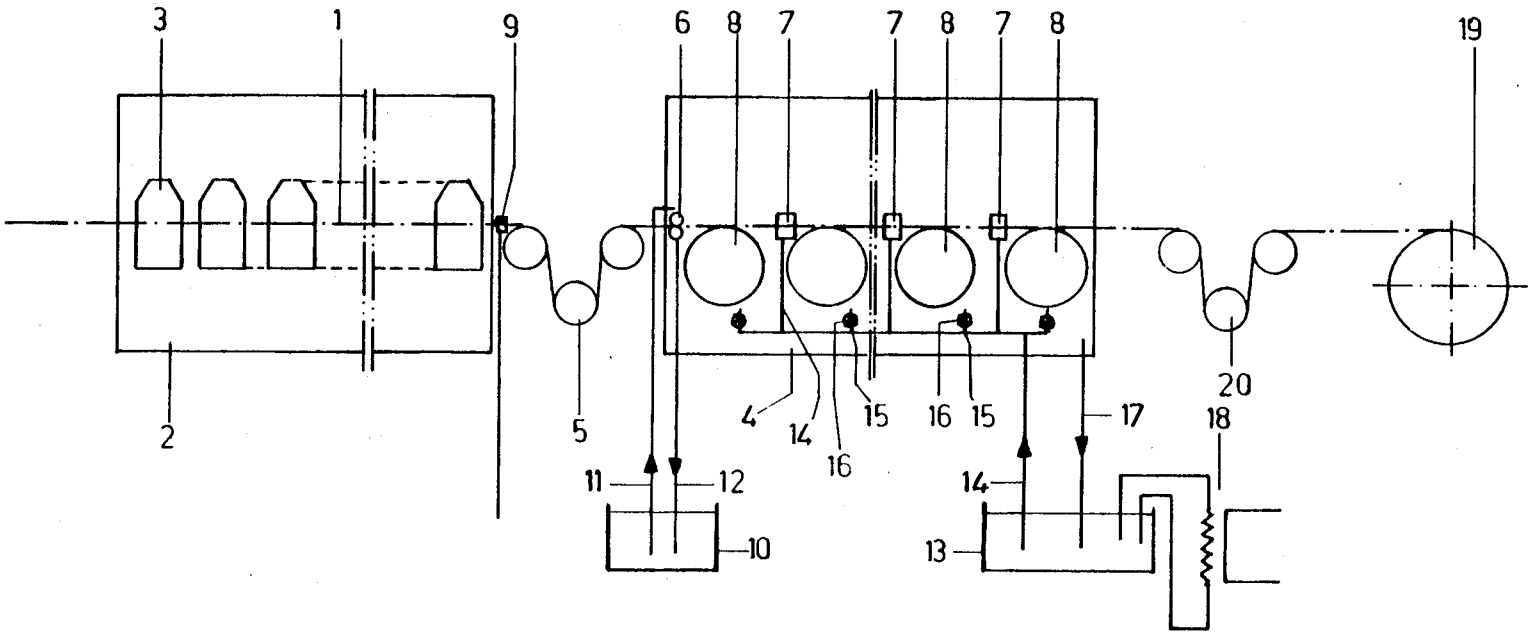
FIG. 1 is a diagrammatic showing of a manufacturing unit being used for the working of the wire-manufacturing method according to the invention.

During a first main step, said wire 1 is elongated down to an intermediate diameter in a cold-rolling section, shown generally in 2 in FIG. 1.

Said rolling section is a rolling unit of that type having a plurality of stands 3, with a constant or fixed reducing in each stand.

Such rolling units are known per se and will thus not be described in detail hereinafter. Such a unit which is particularly suitable, is described under the title "Microrolling: cold-rolling wires of unusual diameters" by G. Properzi in "Wire Journal" December 1979, included herewith by way of reference, and such a unit is sold in the trade by the company Continues SPA from Milano, (Italy), under the name "Micro Rolling Mill".

The number of stands 3 in the rolling unit 2 is dependent on the diameter of the wire 1 fed to the unit, and on the diameter of the wire 1 coming out of the unit.

The rolling unit may moreover be easily adapted to other normalized diameters of wire 1, by removing or adding one or a plurality of stand pairs 3 at the inlet end of unit 2. When another diameter is required for the outcoming wire 1, it is only necessary to remove or add one or a plurality of stands 3 on the outlet end of unit 2.

The normalized diameters for the wire from the hot-rolling operation are 15, 12 and 9.5 mm. The rolling unit 2 is preferably so designed as to require only for passing from a 15 mm diameter to a 12 mm diameter for wire 1, or from a 12 mm diameter to a 9.5 mm diameter for such wire, removing in each case two stands 3 from the inlet end of rolling unit 2.

Said rolling unit 2 may for example be comprised of eight stands, the cross-section reducing of the wire being 20% per stand in the first four stands, and 30% per stand in the other stands. With the diameters for said wire 1, and with respectively eight, six, and four stands 3, the diameter of the rolled wire is 4.75 mm. By removing the last and one-before-last stands 3, there is obtained a wire 1 with a 6.75 mm diameter. The rolls of the various stands 3 are preferably driven by a mechanical transmission from a single D.C. motor.

In some cases, the cross-section of wire 1 may also be changed in shape during a rolling operation in a stand 3, but the wire 1 coming from section 2 preferably has a round cross-section.

During a second step, the cross-section of wire 1 originating from cold-rolling section 2 is reduced down to the final cross-section as required in a wire-drawing section shown generally in 4 in FIG. 1.

Provisions are made for accumulating wire 1 between the rolling section 2 and the drawing section 4 for that case where the output speed of wire 1 from rolling section 2 were to be higher than the feeding speed of the wire to the drawing section 4. Use is made for this purpose of a manufacturing unit comprising an accumulator 5 between rolling section 2 and drawing section 4. Said accumulator is of known design and will consequently not be described hereinafter.

The wire-drawing section 4 is a unit of that type with sliding action and various steps having a constant elongation at each step. Such elongation is only dependent on the structure and particularly on the die.

The wire-drawing section 4 is preferably driven by a D.C. motor.

In a way known per se, the drawing section comprises a number of succeeding dies 6 or 7 which are each followed by a capstan 8. The first die 6 lying at the inlet to the unit is not a normal die like the other dies 7, but rather a roller die.

The wire-drawing section 4 may thus be formed by a drawing unit with normal dies as known, the first die of which is replaced by a roller die which is also known per se. Neither said roller die, nor said wire-drawing unit will be described in detail hereinafter.

The following units as available in the trade are particularly suitable for the working of the method according to the invention, after replacing the first normal die 7 by a roller die 6: drawing unit type H 750 from Maschinenfabrik Herborn, unit type 8-DXT-550 from Hi-Draw Machinery Limited, and machine type KDA from the Bekaert Company.

The use of a roller die 6 for the first wire-drawing step instead of a normal die is based on the fact that in the rolling section 2, the wire is lubricated by means of a water suspension as thus is normally the case in rolling units, while in wire-drawing section 4, said wire 1 is lubricated and cooled with oil, as described hereinafter. Now said oil is not compatible with the suspension water. The combination of rolling and drawing operations thus brings the problem of removing any trace of suspension from said wire 1 between rolling section 2 and drawing section 4, or at least the normal dies 7 from said drawing section 4.

The major part of the suspension is removed from wire 1 with a pressurized air stream which is directed on said wire 1 with a head 9 which is mounted between rolling section 2 and accumulator 5.

After moving past head 9, said wire 1 may still have traces of suspension. Such traces are removed together with the oil being used for lubricating the roller die 6. Said oil is circulated in closed circuit. The oil is pumped from a tank 10 through a line 11. The oil is returned to tank 10 through return line 12. Said closed circuit is completely independent from the oil being used for lubricating the other dies 7. The slightest trace of water in said latter oil might indeed hamper the drawing in the dies 7. A roller die on the other hand is less sensitive to traces of water in the lubricating oil and this in the reason why the first die 6 should preferably be a roller die.

Both the dies 7 and the capstans 8 are lubricated and cooled by oil which is pumped from a tank 13. Said oil is fed through inlet lines 14 to dies 7 and through lines 15 to capstans 8. Each line 15 is provided with a valve 16 which may be remotely controlled. All the oil is collected on the bottom of the drawing unit and returned to tank 13 through a return line 17.

The oil returning to tank 13 has been heated. The oil from tank 13 is continuously cooled by returning such oil in closed circuit through a heat exchanger 18.

The amount of oil which is sprinkled over each capstan and consequently the cooling of wire 1 in each step may be adjusted by means of the valve 16 in the corresponding line 15. It is thus possible to act on the total heating of wire 1 inside the drawing section 4.

It is also and mostly possible to act on the heating by influencing the speed of wire 1, as the wire heating inside drawing section 4 is proportional to the speed of said wire 1.

The use of a D.C. motor to drive both rolling section 2 and drawing section 4 allows to control easily and accurately the speed ratio for the wire inside both said units. The cross-section reducing for wire 1 during the first step of drawing section 4 may thus easily be adapted to the final wire diameter being required.

After wire-drawing thereof, the wire 1 is wound by means of a coiling machine 19 with automatic coil-changing Said coiling machine 19 is also driven by means of a D.C. motor. Such coiling machines are known per se and will thus not be described hereinafter.

Between wire-drawing section 4 and coiling machine 19 is provided an accumulator 20 which allows balancing any possible difference between the wire output speed from drawing section 4 and the wire winding speed of coiling machine 19.

Rolling section 2, accumulator 5, wire-drawing section 4, accumulator 20, and coiling machine 19 are mounted in a line in the manufacturing unit.

The above-described method is particularly suitable for wires from aluminum or aluminum alloy. Among others, the following wires designated according to the Aluminum Association specification, are particularly suitable for working with the method according to the invention: 1 100, 1 199; 1 350; 1 370; 2 011; 2 017; 2 024; 2 117; 4 043; 5 005; 5 052; 5 056; 5 356; 6 053; 6 061; 6 110; 6 201 and 6 262.

The above-described method has substantial advantages relative to a method which only comprises cold-rolling or wire-drawing.

The above-described method requires a lower number of dies than when the wire cross-section reducing is obtained solely by wire-drawing. This results in feeding a new wire to the device for the working of the method being possible in a quite fast way and without too much difficulties.

The wire cross-section reducing by wire-drawing is also smaller. There results therefrom a lowering of the wire overstressing, both on the surface and inside the wire. There is consequently less danger of the wire breaking and less danger of surface faults on the wire. There is a lower increase in wire temperature during the method, in such a way that the wire-drawing speeds may be higher. The temperature rise during cold-rolling is indeed much less substantial than during wire-drawing. Moreover it is possible to cool the wire, when required, between the rolling unit 2 and the drawing unit 4.

With respect to a method which only comprises cold-rolling, the above-described method has for advantage a better quality of the resulting wire. The wire surface is more perfect and it is possible to obtain a wire with very accurate size and shape.

The combination of a cold-rolling step and a wire-drawing step moreover results in an increased flexibility of use, and mostly a higher throughput of wire having the required technical features. It is indeed easy to act on the wire temperature as it is the case with methods which comprise solely a wire-drawing, but the wire speeds may be higher than with the known methods as defined above.

It did appear that said additional advantages are mostly of importance when use is made of wire from aluminum alloy comprising magnesium and silicon, particularly such an alloy as used for making electric leads. Such advantages are important when use is made for example of a wire from one of the following alloys, defined according to the Aluminum Association specification: 6 053; 6 061; 6 110; 6 201 and 6 262. The method according to the invention is more particularly advantageous for wire 6 201 as shown by the following comparison example.

EXAMPLE

A rod wire with a diameter of 9.5 mm, from aluminum-magnesium-silicon alloy no. 6 201 according to Aluminum Association specification, has been reduced to 3.15 mm diameter. The chemical alloy composition has been determined:

Mg: 0.57%
Si: 0.59%
Fe: 0.23%
Al: remainder.

The other elements are impurities which occur normally in Al-Mg-Si alloys as used for manufacturing electric leads.

The rod wire has been obtained by continuous melting and rolling according to Properzi type (Properzi rolling mill no. 7 from Continuus SPA), according to the method as described in Luxemburg Pat. No. 80,656 included herewith by way of reference.

The wire cross-section has been reduced with three different methods. In each case, the wire temperature on the coil from the coiling machine at the outlet end of the manufacturing unit, and the breaking stress, the elongation and the resistivity of the resulting wire have been measured for different wire speeds.

1. With a known method comprising solely a wire-drawing:

The wire-drawing has been performed in a Niehoff unit M 85 with a die set resulting in an elongation of about 32.5%, to the exception of the last pass, where the elongation was about 27%.

| speed, m/s | 6 | 10 | 16 | 20 |
|---|---|---|---|---|
| temperature, °C. | 81 | 122 | 159 | 177 |
| breaking stress, MPa | 335 | 341 | 352 | 339 |
| elongation, % | 4.2 | 4.4 | 4.7 | 4.8 |
| resistivity, $10^{-11}$ ohm.m | 3,140 | 3,125 | 3,108 | 3,100 |

2. With a known method comprising solely a rolling:

The rolling has been performed on a machine with constant cross-section reducing.

| speed, m/s | 7 | 13 | 20 |
|---|---|---|---|
| temperature, °C. | 30 | 61 | 82 |
| breaking stress, MPa | 324 | 336 | 353 |
| elongation, % | 2.1 | 2.7 | 3.1 |
| resistivity, $10^{-11}$ ohm.m | 3,194 | 3,166 | 3,145 |

3. With the method according to the invention:

During a first step, the rod wire has been reduced in cross-section from 9.5 mm to 4.75 mm in four steps in a unit of type Micro-Rolling Mill from the company Continuus SPA in Milano (Italy). During a second operating step, the wire has been reduced down to the final diameter in a wire-drawing unit with constant elongation at each die, but with the first die thereof being replaced by a roller die. The wire-drawing has been performed in four passes with constant elongation, that is a 27.5% elongation. Dies of the following size have been used: 4.50 mm; 4.01 mm; 3.56 mm, and 3.15 mm.

| speed, m/s | 10 | 20 | 30 |
|---|---|---|---|
| temperature, °C. | 130 | 138 | 152 |
| breaking stress, MPa | 342 | 351 | 364 |
| elongation, % | 4.3 | 4.6 | 5.1 |
| resistivity, $10^{-11}$ ohm.m | 3,115 | 3,109 | 3,092 |

Figure 2:
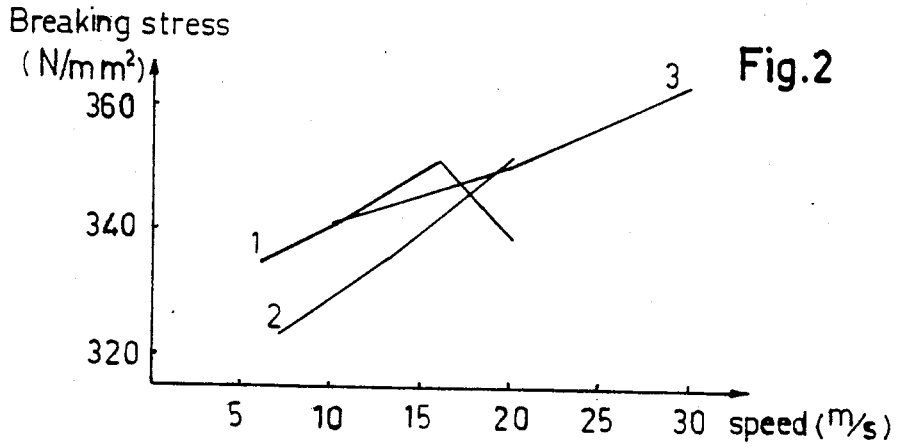
FIG. 2 is a diagram showing the breaking stress of a wire according to the output speed thereof from the manufacturing unit, when said wire is obtained respectively with the method according to the invention, solely by rolling and solely by wire-drawing.
Figure 3:
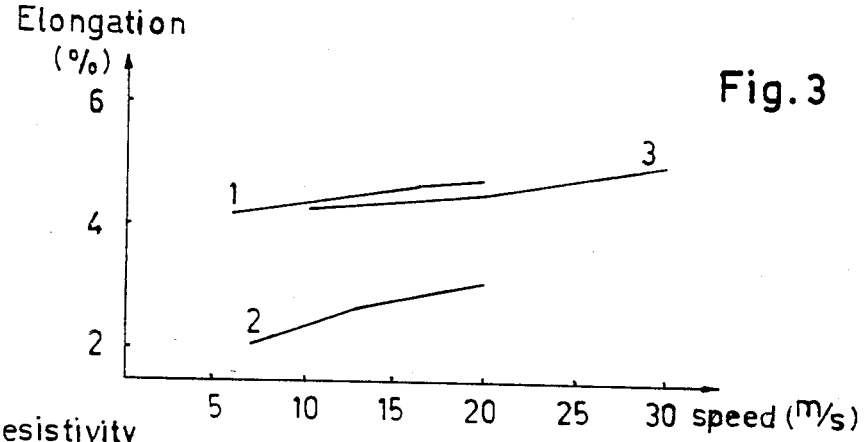
FIG. 3 is a diagram similar to the one in FIG. 2, but showing the elongation of the resulting wire according to the output speed thereof.
Figure 4:
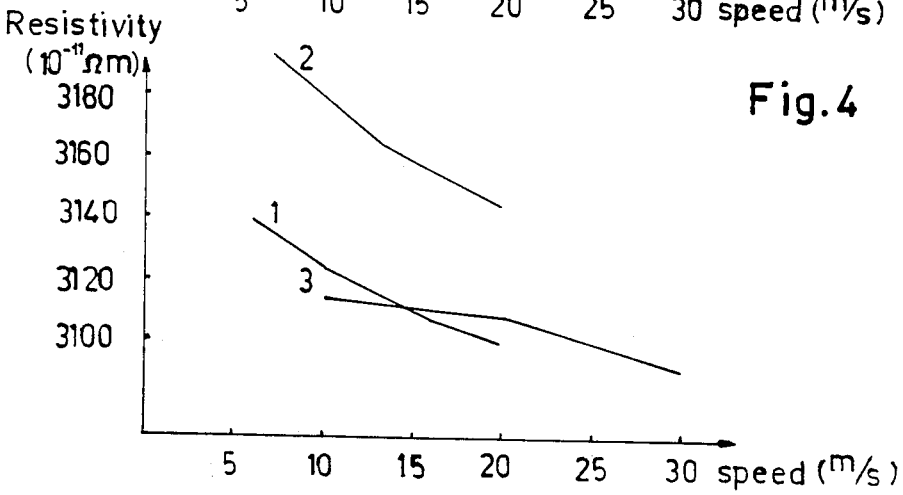
FIG. 4 is a diagram similar to the one in FIGS. 2 and 3, but showing the resistivity of the resulting wire according to the output speed thereof.

To enable an easy comparison of the mechanical and electric features of the wire obtained according to said three methods, the obtained results have been plotted in a diagram in FIGS. 2,3 and 4. In said figures, the breaking stress, the elongation, and the resistivity have been shown as a function of the speed for the three methods. In each figure, curve 1 corresponds to the known method comprising but wire-drawing, curve 2 corresponds to the method comprising but rolling, and curve 3 corresponds to the method according to the invention.

It appears from the results that the method according to the invention easily allows to optimize the pair breaking stress-resistivity.

It must be understood that the invention is in no way limited to the embodiment as described hereinbefore, and that many changes may be brought thereto without departing from the scope of the present invention.

In particular, the method is not limited to wires from aluminum alloy.

Both the rolling and drawing do not have necessarily to be performed in sections with constant cross-section reducing in each step. The reducing in cross-section can vary at each step or part of the steps.

The wire-drawing section should not necessarily be comprised of a roller die and normal dies. Said section might comprise no roller die or more than one roller die, or even be comprised only of such roller dies.

The wire-drawing section should not necessarily either be comprised of a sliding drawing unit. Each coil might for example be driven separately by a motor without substantial sliding.

I claim:

1. Method for manufacturing aluminum and aluminum alloy wire with a reduced cross-section from wire with a larger cross-section, which comprises the steps of:

first reducing the wire cross-section down to an intermediate cross-section by subjecting said wire to a plurality of cold-rolling reductions in a rolling section with a plurality of stands using a water suspension as lubricant, removing suspension remainders from the wire by means of a pressurized air stream, then continuously further reducing the wire cross-section down to the required cross-section by drawing in a plurality of passes in a wire-drawing section while applying oil to said wire as a lubricant, the first step in the cross-section reducing by wire-drawing being performed by passing said wire through a roller die, and circulating the oil used for lubricating the roller die in a circuit which is completely independent from oil circuits which are used for lubricating the wire in the other drawing steps, the wire being cooled in a controlled way in the wire-drawing section.

* * * * *